US005187499A

United States Patent [19]

Murakami

[11] Patent Number: 5,187,499

[45] Date of Patent: Feb. 16, 1993

[54] LIQUID JET RECORDING HEAD WITH PROTECTIVE LAYER HAVING AN ION EXCHANGER

[75] Inventor: Keiichi Murakami, Tokyo, Japan

[73] Assignee: Canon Kabushiki Kaisha, Tokyo, Japan

[21] Appl. No.: 768,946

[22] PCT Filed: Mar. 27, 1991

[86] PCT No.: PCT/JP91/00400

§ 371 Date: Oct. 22, 1991

§ 102(e) Date: Oct. 22, 1991

[87] PCT Pub. No.: WO91/14575

PCT Pub. Date: Oct. 3, 1991

[30] Foreign Application Priority Data

Mar. 27, 1990 [JP] Japan ..... 2-75434

[51] Int. Cl.[5] ..... B41J 2/05

[52] U.S. Cl. ..... 346/140 R

[58] Field of Search ..... 346/140 R; 521/25-39

[56] References Cited

U.S. PATENT DOCUMENTS 4,567,493 1/1986 Ikeda ..... 346/140 R
4,626,875 12/1986 Hara ..... 346/140 R
5,010,355 4/1991 Hawkins ..... 346/140 R

FOREIGN PATENT DOCUMENTS 104763 5/1987 Japan .
122443 5/1989 Japan .

*Primary Examiner*—Joseph W. Hartary
*Attorney, Agent, or Firm*—Fitzpatrick, Cella, Harper & Scinto

[57] ABSTRACT

A liquid jet recording head having a support member, an electrothermal converting body on the support member, the converting body including a heat generating resistor layer and electrodes electrically connected to the layer, and an upper protective layer over the converting body containing a ion exchanger. The ion exchanger functions to trap mobile ions permeating from the liquid flowing through the recording head thereby preventing corrosion.

20 Claims, 4 Drawing Sheets

LIQUID JET RECORDING HEAD WITH PROTECTIVE LAYER HAVING AN ION EXCHANGER

FIELD OF THE INVENTION

The present invention relates to a liquid jet recording head for discharging recording liquid to record images of characters or the like. The present invention relates also to a substrate for liquid jet recording head for use in the preparation of the aforesaid head. The present invention further relates to a liquid jet recording apparatus provided with the aforesaid head.

BACKGROUND OF THE INVENTION

As for a liquid jet recording system (hereinafter occasionally referred to as "ink jet recording system"), there have been proposed a variety of systems. Among such proposals, as a typical one, the public attention has been focused on those liquid jet recording systems disclosed, for example, in U.S. Pat. No. 4,723,129 or 4,740,796 in recent years. These systems are of the type in short that recording liquid (hereinafter occasionally referred to as "ink") is discharged utilizing thermal energy and recording is performed with the liquid discharged. And there are advantages for these liquid jet recording systems that recording of a high quality image with a high density and a high resolution can be performed at a high speed, and it is relatively easy to attain miniaturization of a head or an apparatus.

A typical embodiment of the head in which such liquid jet recording system utilizing thermal energy is applied comprises a discharging outlet for discharging liquid, a liquid pathway in communication with said discharging outlet and having, as part of its constituent, a heat acting portion at which thermal energy, which is utilized for discharging the liquid from the discharging outlet, is effected to the liquid, and an electrothermal converting body which is disposed to correspond to the liquid pathway and which serves to generate the thermal energy to be utilized for discharging the liquid. And this electrothermal converting body has, in general, a pair of electrodes and a heat generating resistor layer disposed to connect said pair of electrodes and to form an exothermic region (heat generating portion). On this electrothermal converting body, an upper protective layer capable of protecting the electrothermal converting body from recording liquid is usually disposed. An example of the constitution of a substrate for liquid jet recording head to be used for the preparation of such liquid jet recording head is shown in FIG. 1(*a*) through FIG. 1(*b*).

FIG. 1(*a*) is a schematic plan view (including partial perspective views for explanatory purpose) of the principal portion of an example of the substrate for liquid jet recording head. FIG. 1(*b*) is a cross section view taken along the chain line X - Y in FIG. 1(*a*).

In FIG. 1(*a*) and FIG. 1(*b*), a substrate 101 for liquid jet recording head comprises a lower layer 106, a heat generating resistor layer 107, a pair of electrode layers 103 and 104, a first upper protective layer 108, a second upper protective layer 109 and a third upper protective layer 110 being laminated in this order on a support member 105. A portion 111 of the heat generating resistor layer 107 which is situated between the electrodes 103 and 104 forms a heat generating portion. Details of the respective constituents will be described later.

As for the material of which each of the upper protective layers in such substrate 101 for liquid jet recording head is formed, it is properly selected depending upon the characteristics required therefor such as heat resistance, resistance to liquid, thermal conductivity and insulating property. The principal role of the first upper protective layer 108 is to insulate between the electrode 103 and the electrode 104. The principal role of the second upper protective layer is to reinforce the resistance to liquid and the mechanical strength. The principal role of the third upper protective layer is to prevent liquid permeation and to improve the resistance to liquid. And in order to meet such requirements with respect to the characteristics, in many cases, the first upper protective layer is formed of an inorganic insulating material, the second upper protective layer is formed of an inorganic material (specifically, a metallic material), and the third upper protective layer is formed of an organic material.

There have been produced liquid jet recording heads with a relatively high reliability using such substrate for liquid jet recording head as above mentioned, and liquid jet recording apparatus provided with those liquid jet recording heads have been commercialized.

However, for the commercially available liquid jet recording apparatus, there is a societal demand for further improvement in the recording speed and for further improvement in the quality of an image recorded. As one of ideal liquid jet recording heads capable of meeting such social demand, there can be mentioned a liquid jet recording head that is basically provided with numerous liquid discharging outlets as many as possible being arranged at a high density and that can be repeatedly used for a long period of time without deteriorating.

In order to realize such ideal liquid jet recording head, such a matter as will be mentioned in the following as the subject to be solved. That is, in the case of a liquid jet recording head provided with numerous discharging outlets being arranged at a high density, there is a problem that the electrothermal converting bodies including the electrodes are apt to gradually corrode with a recording liquid when it is frequently and continuously used for a long period of time.

The above matter is not serious and can be more or less admitted in the case of a head provided with a relatively small number of discharging outlets being arranged at a relatively low density (for the reason in this regard, it is presumed that the head is substantially small in the number of portions liable to cause a problem and the probability of causing a problem is substantially small). However, the above matter is a subject which cannot be slighted in the case where numerous discharging outlets are arranged at a high density. Particularly, it is a serious technical subject in the case of a so-called full-line type liquid jet recording head which is provided with numerous discharging outlets being arranged at a high density along the entire width of the recording area of a member on which an image is to be recorded in which numerous electrothermal converting bodies are arranged at a high density on a base member such that they correspond to said numerous discharging outlets.

SUMMARY OF THE INVENTION

A principal object of the present invention is to overcome the foregoing technical challenge and to provide a liquid jet recording head which excels in durability and reliability even upon frequent repeated use or continuous use for a long period of time.

Another object of the present invention is to overcome the foregoing technical challenge by contriving a specific design to the upper protective layer of a liquid jet recording head of the system that ink is discharged utilizing thermal energy and to provide an improved liquid jet recording head with a markedly improved reliability.

A further object of the present invention is to provide a liquid jet recording head wherein the foregoing technical problem, which is liable to arise in a liquid jet recording head provided with a plurality of electrothermal converting bodies capable of generating thermal energy to be utilized for discharging liquid and in which said plurality of electrothermal converting bodies are arranged at a high density on a base member, can be solved by a relatively simple structural contrivance.

A further object of the present invention is to provide a liquid jet recording head wherein the foregoing technical problem, which is liable to arise in a full-line type liquid jet recording head provided with numerous discharging outlets being arranged at a high density along the entire width of a recording area of a recording member on which record is to be made and in which numerous electrothermal converting bodies are arranged at a high density on a substrate such that they correspond to said numerous discharging outlets, can be solved by a relatively simple structural contrivance.

A further object of the present invention is to provide a substrate for liquid jet recording head which is used for the preparation of the above head and a liquid jet recording apparatus provided with the above head.

Research and study has been made and studies in order to solve the foregoing subject and attain the above objects. As a result, it has been recognized that there are often found, among others, several such liquid jet recording heads that are insufficient in the formulation of the upper protective layer at the step portion of the patterned electrode or have defects such as pinholes or the like in the upper protective layer; and when these liquid jet recording heads are used continuously for a long period of time, mobile ions such as sodium ion, chlorine ion, etc. contained in a recording liquid permeate into the upper protective layer and those ions permeated into the upper protective layer arrive at the electrothermal converting body, thereby causing corrosion at the electrothermal converting body.

Further studies have been made on the basis of this finding, and as a result, the following knowledge has been obtained. That is, an ion exchanger has been experimentally incorporated into the upper protective layer coating the electrothermal converting body. As a result, it has been found that ion exchange reaction can be effectively applied to a liquid jet recording head, wherein the mobile ions such as sodium ion, chlorine ion, etc. in the recording liquid can be trapped within the upper protective layer. The knowledge thus obtained has been applied in the preparation of a liquid jet recording head. As a result, it has been found that the situation of occurring corrosion of the electrothermal converting body including electrodes for the resultant liquid jet recording head is markedly improved in comparison with that in the prior art. The resultant liquid jet recording head has been applied to an apparatus body to discharge recording liquid, thereby performing recording. As a result, it has been found that the liquid jet recording head is one that sufficiently attains the foregoing objects of the present invention.

Thus, the present invention has been accomplished. The liquid jet recording head according to the present invention is characterized in that it comprises a substrate for liquid jet recording head comprising a support member, an electrothermal converting body disposed on said support member, said electrothermal converting body including a heat generating resistor layer and electrodes being electrically connected to said heat generating resistor layer, and an upper protective layer containing an ion exchanger disposed to cover said electrothermal converting body; and a liquid pathway in communication with a discharging outlet capable of discharging liquid is disposed on said substrate for liquid jet recording head such that it corresponds to a heat generating portion of said electrothermal converting body.

The present invention further includes the above substrate for liquid jet recording head for use in the preparation of the above head and a liquid jet recording apparatus provided with the above head.

BRIEF DESCRIPTION OF THE DRAWINGS

FIG. 1(*b*) is a schematic cross section view taken along the chain line in FIG. 1(*a*).

DETAILED DESCRIPTION OF THE PREFERRED EMBODIMENTS

A preferred embodiment of the present invention is to be explained with reference to the drawings.

Figure 1A:
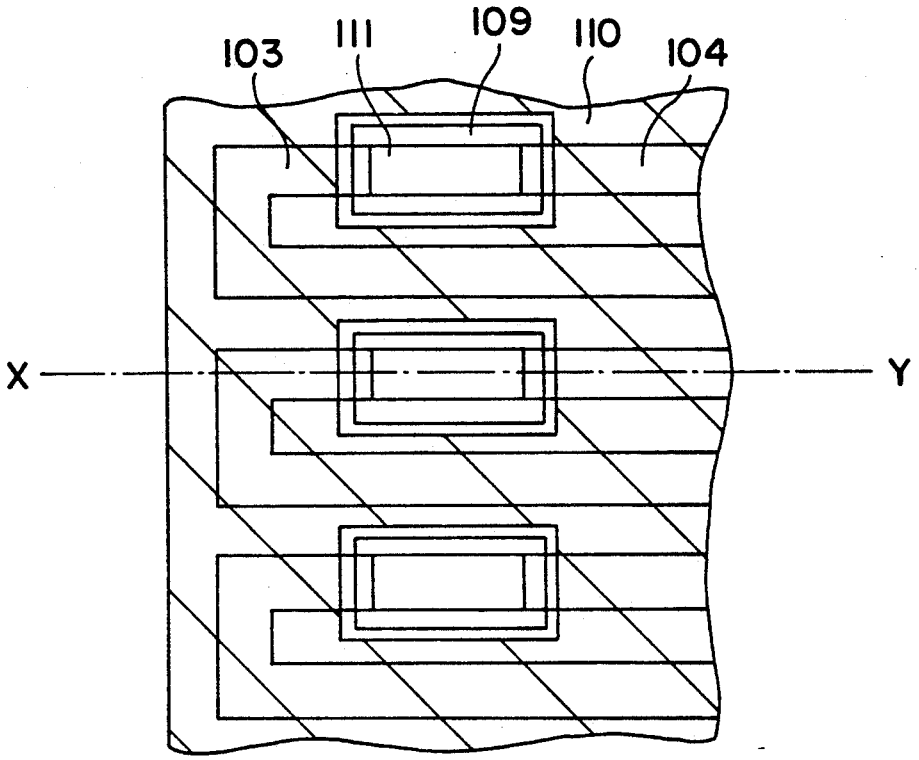
FIG. 1(*a*) is a schematic plan view illustrating the principal part of an embodiment of a substrate for liquid jet recording head.
Figure 1B:
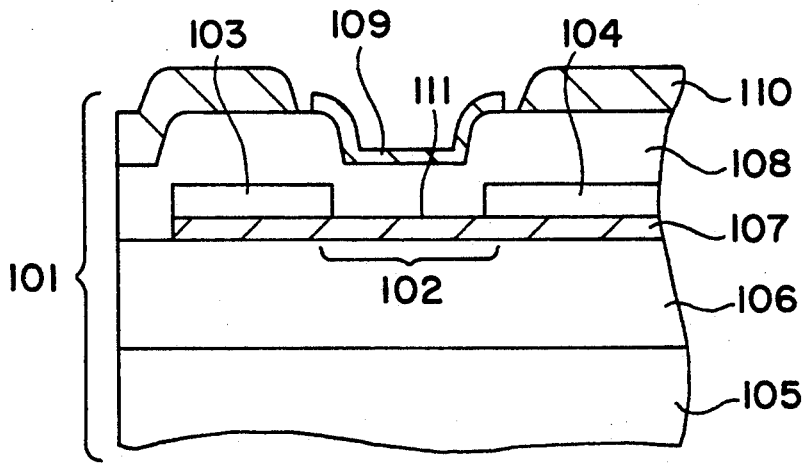

In a substrate 101 for liquid jet recording head shown in FIG. 1(*a*) and FIG. 1(*b*), reference numeral 105 stands for a support member composed of a metal such as silicon, glass, ceramics, or the like. On this support member 105 is disposed a lower layer 106 which serves to appropriately control thermal energy generated and to make said thermal energy uniform over the entirety of the substrate. This lower layer 106 is composed of an insulating material such as silicon oxide, etc.

On the lower layer 106 is disposed a heat generating resistor layer 107 which serves to generate thermal energy to be utilized for discharging liquid. As the material of which the heat generating resistor layer 107 is composed, materials capable of generating thermal energy as desired upon energizing them may be used. Specific examples of such material can include tantalum nitride, nichrome, Ag-palladium alloy, silicon semiconductor, metals such as hafnium, lanthanum, zirconium, titanium, tantalum, tungsten, molybdenum, niobium, chromium, vanadium, etc, alloys of these metals, and borides of said metals. The heat generating resistor layer 107 can be formed by a vapor phase reaction method such as a sputtering method, a CVD method, an evaporation method, or the like.

On the heat generating resistor layer 107 are disposed a pair of electrodes 103 and 104 which serve to impart an electric signal to the heat generating resistor layer 107. The portion of the heat generating resistor layer 107 situated between said pair of electrodes 103 and 104 farms to be a heat generating portion capable of generating thermal energy to be utilized for discharging liquid. As the material of which the electrodes 103 and 104 are composed, conventional electrode materials can be mostly used. Specific examples of such material can include metals such as Al, Ag, Au, Pt, Cu, etc. These electrodes can be formed by a vapor phase reaction method such as a sputtering method, a CVD method, an evaporation method, or the like.

In order to protect the electrothermal converting body including the heat generating resistor layer 107 and the pair of electrodes 103 and 104, various upper protective layers are disposed on said electrothermal converting body. As for the material of which such upper protective layer is composed, it is selectively used depending upon the characteristics such as heat resistance, resistance to liquid, thermal conductivity, insulating property, and the like as required for the layer to be formed.

The principal role of a first upper protective layer 108 is to establish insulation between the electrodes 103 and 104. The first protective layer 108 is composed of an inorganic insulating material such as inorganic oxides e.g. $SiO_2$, etc. and inorganic nitrides e.g. $Si_3N_4$, etc. The first upper protective layer 108 can be formed by a vapor phase reaction method such as a sputtering method, a CVD method, an evaporation method, or the like or a liquid coating method.

The principal role of a second upper protective layer 109 is to reinforce the resistance to liquid and the mechanical strength. The second upper protective layer 109 is composed of a material which is tough, relatively excels in mechanical strength and exhibits an adhesion property to the first upper protective layer 108. Specific examples of such material can include elements of the group IIIa of the periodic table such as Sc, Y, etc., elements of the group IVa of the periodic table such as Ti, Zr, Hf, etc., elements of the group Va of the periodic table such as V, Nb, Ta, etc., elements of the group VIa of the periodic table such as Cr, Mo, W, etc., elements of the group VIII of the periodic table such as Fe, Co, Ni, etc., alloys, borides, carbides, and nitrides of said metals. The second upper protective layer 109 can be formed by a vapor phase reaction method such as a sputtering method, a CVD method, an evaporation method or the like.

The principal role of a third upper protective layer is to prevent liquid permeation and to improve the resistance to liquid. In this embodiment, the third upper protective layer 110 is composed of a material containing an inorganic ion exchanger and an organic material as the main component, specifically, an organic material substantially containing an inorganic ion exchanger. As the material to be an ion exchanger-containing body material, it is preferred to use an organic material rather than an inorganic material. The reason for this is that the mobility of an ion in an organic material is higher than that in an inorganic material. The third upper protective layer 110 can be formed by a liquid coating method or the like.

The organic material usable herein can include, for example, silicone resin, fluorine-containing resin, aromatic polyamide, addition polymerized type polyimide, polybenzimidazole, metal chelate polymer, titanic ester, epoxy resin, phthalic acid resin, thermosetting phenol resin, p-vinylphenol resin, zirox resin, triazine resin, BT resin (triazine resin - addition polymerized resin of bismaleimide), polyxylene resin, and derivatives of these. Specifically, photosensitive polyimide resins such as polyimidoisoindoloquinazolinedion (trademark name : PIQ, product by Hitachi Chemical Co., Ltd.), polyimide resin (trademark name:PYRAIN, product by Du Pont Company), cyclicpolybutadiene resin (trademark name:JSR-CBR, product by Japan Synthetic Rubber Co., Ltd.), and PHOTONEECE (trademark name, product by Toray Industries, Inc.) are desirably used since they excel particularly in highly precise microprocessing properties.

As the ion exchanger, it is desired to use an inorganic ion exchanger. The reason for this is that those ions which are contained in a recording liquid and cause the foregoing disadvantages are mostly inorganic mobile ions such as sodium ions, chlorine ions, etc.

As such inorganic ion exchanger, there can be mentioned, for example, IXE, GRADE IXE-100, GRADE IXE-200, GRADE IXE-300, GRADE IXE-400, GRADE IXE-500, GRADE IXE-600, GRADE IXE-700, GRADE IXE-800, GRADE IXE-900, GRADE IXE-1000, GRADE IXE-1100, GRADE IXE-1200 and GRADE IXE-1300 (all of these are trademark names; products by Toagosei Chemical Industry Co., Ltd.). Among these inorganic ion exchangers, GRADE IXE-600, GRADE IXE-1200 and GRADE IXE-1300 are the most desirable.

It is considered that the ion exchanger functions to trap mobile ions such as sodium ions, chlorine ions, etc., which will be permeated from liquid flowing through the liquid pathways of the liquid jet recording head, through ion exchange reaction within the upper protective layer wherein said ion exchanger is contained and because of this, such mobile ions are prevented from getting into the layer situated under the upper protective layer. As a result, the electrothermal converting body can be maintained without being suffered from corrosion.

It is desired for the ion exchanger to be contained in an amount of 1 to 5 percent by weight in the corresponding upper protective layer in which the ion exchanger is to be contained. In the case where the amount of the ion exchanger to be contained is less than 1 percent by weight, its function to trap the foregoing mobile ions becomes insufficient, where the residual mobile ions, which have not been trapped by the ion exchanger, often arrive at the electrothermal converting body to cause corrosion for the electrothermal converting body. On the other hand, in the case where the amount of the ion exchanger to be contained exceeds 5 percent by weight, the ion exchanger is hardly dispersed in the body material in a uniform state to cause reduction in the hardness, strength and adhesion, and also to cause reduction in the photosensitivity in the case where the body material is photosensitive.

As for the state of the ion exchanger to be contained in the main constituent material, it is the most desirable to take a state that the ion exchanger is dispersed therein. In order to provide such state, there can be employed an appropriate method such as a method wherein the ion exchanger is dispersed in a given solution and the resultant is set to be in a layered state or a method wherein the ion exchanger is introduced into a given molten medium, followed by solidification to obtain a product containing the ion exchanger in a dispersed state therein, and the product is subjected to treatment by an evaporation process or a sputtering process to make it to be a layered form. Of these methods, the former method is the most appropriate in view of uniform dispersion of the ion exchanger in the layer and also in view of productivity.

The effects of the present invention becomes significant in the case of using the ion exchanger-containing upper protective layer in the vicinity of the heat energy generating portion of a liquid jet recording head of the configuration using thermal energy as the energy for discharging liquid. For the reason in this outcome, it is considered that the recording liquid is heated to a relatively high temperature in the vicinity of the heat energy generating portion (that becomes one of the causes of causing corrosion of the electrothermal converting body in the prior art), and because of this, mobile ions in the recording liquid are enabled to permeate and diffuse into the upper protective layer, wherein those mobile ions are effectively trapped by the ion exchanger contained therein.

In the above, explanation has been made of the case when the third upper protective layer 110 is composed of the organic material containing the ion exchanger, but the present invention is not limited to this embodiment.

That is, the present invention includes an alternative that at least a part of the upper protective layer, which is disposed to cover the electrothermal converting body, is composed of a material containing the ion exchanger. Specifically, for instance, the present invention includes such a head that has a first upper protective layer composed of an inorganic material containing the ion exchanger.

As an example of the method of forming such inorganic upper protective layer, there can be mentioned a method wherein a silicon-containing compound such as $RnSi(OH)_{4-n}$, $Si(OH)_4$, $HnSi(OH)_{4-n}$ or $(RO)_n$-$Si(OH)_{4-n}$ is dissolved in an organic solvent comprising alcohol as the principal component and ester or ketone together with a vitrifying material comprising a compound of P, B, Al, As, Zn or Ti or an organic binder, followed by dissolving the ion exchanger therein, and the resultant is applied by a conventional coating method such as a spin coating method, a roll coating method, a dip coating method, a spray coating method or a brush coating method, followed by subjecting to baking, to thereby form an inorganic upper protective layer containing $SiO_2$ as the main constituent.

The present invention is not limited only to the above described embodiment also with respect to the layer constitution of the upper protective layer and the materials to be used for the formation thereof.

For instance, the present invention includes a case wherein the third upper protective layer 110 is composed of an inorganic material containing the ion exchanger and a case wherein the first upper protective layer 108 is composed of an organic material containing the ion exchanger. In addition, the present invention can include such a configuration with respect to the upper protective layer that the upper protective layer covering the electrothermal converting body comprises solely a first upper protective layer 108 composed of a material containing the ion exchanger. In any case, the embodiment which has been described at the beginning in the above is the most desirable in the present invention in view of functional balance in the layer constitution.

Figure 2:
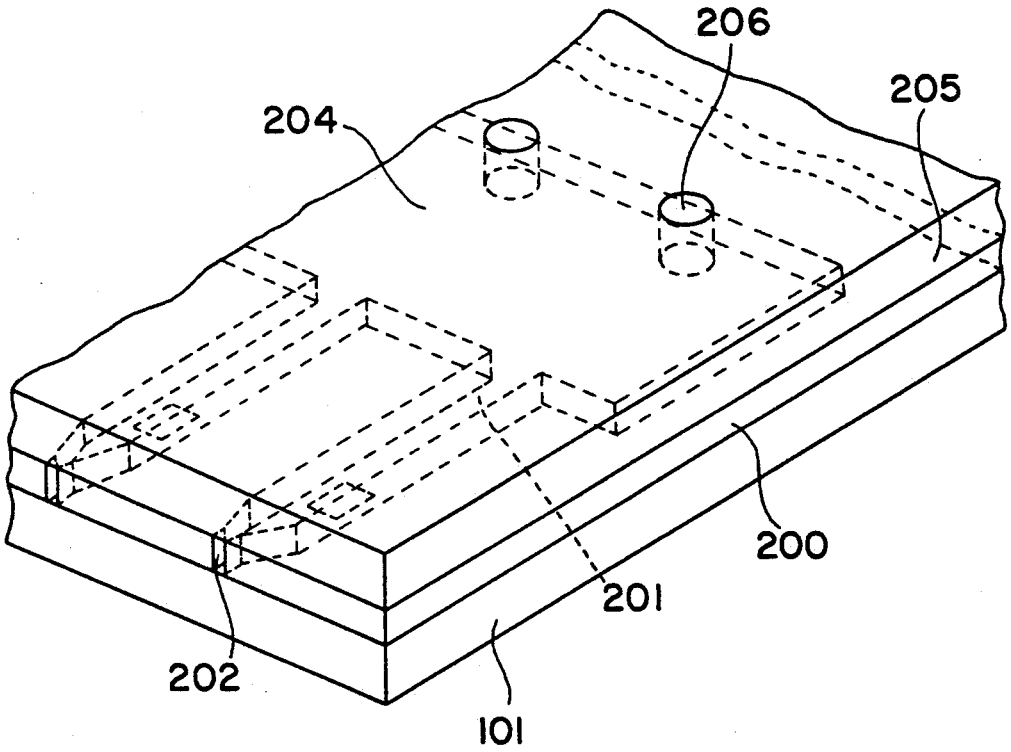
FIG. 2 PRIOR ART
FIG. 2 is a schematic slant view illustrating the principal portion of an embodiment of a liquid jet recording head prepared by using the above substrate for liquid jet recording head.

FIG. 2 is a schematic slant view illustrating the principal configuration of an example of a liquid jet recording head prepared by using the foregoing substrate for liquid jet recording head.

In the figure, on a substrate 101 in which heat generating portions (hatched portions) of an electrothermal converting body are arranged, there is disposed a wall 200 for liquid pathways 201, on which a top plate 205 is disposed. Recording liquid is supplied from a liquid reservoir (not shown in the figure) through liquid throughholes 206 into a common liquid chamber 204. The liquid supplied into the common liquid chamber 204 is then supplied into the liquid pathways 201 due to the so-called capillary action and it is stably maintained by forming meniscus in discharging outlets 202 in communication with the liquid pathways 202. The liquid present on the heat generating portions of the electrothermal converting body is instantly heated upon heat generation at said heat generating portions to cause formation of gas bubble to the liquid in the liquid pathways 201, whereby jetting out liquid through the discharging outlets 202. In this figure, there is described the principal part of a liquid jet recording head provided with, for example, 128 discharging outlets at a high arrangement density of 8 discharging outlets per millimeter.

Figure 3:
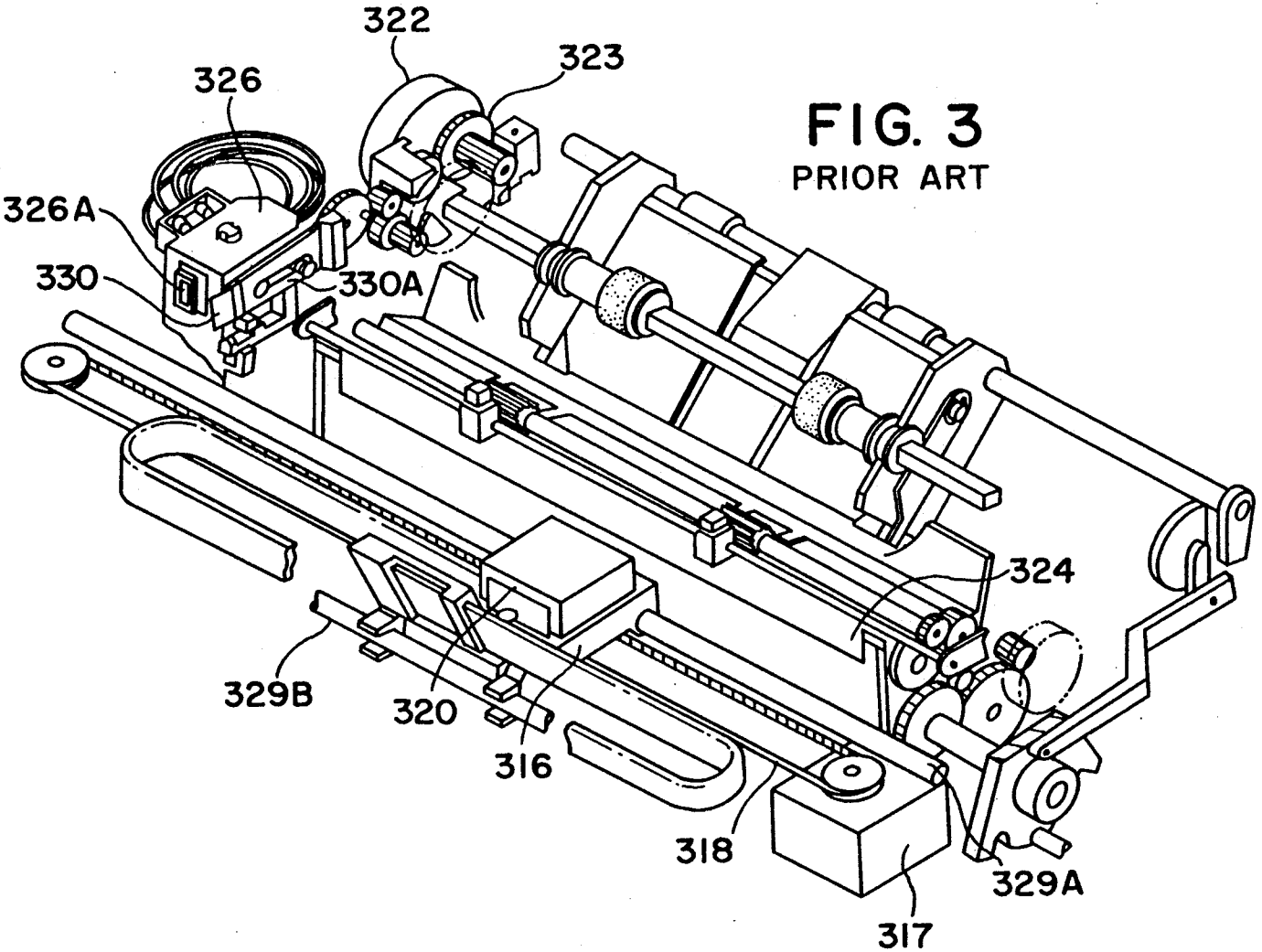
FIG. 3 PRIOR ART
FIG. 3 is a schematic slant view illustrating the principal portion of an embodiment of a liquid jet recording apparatus provided with the liquid jet recording head shown in FIG. 2.

FIG. 3 is a schematic slant view illustrating the principal part of an embodiment of a liquid jet recording apparatus which is provided with the liquid jet recording head shown in FIG. 2.

In FIG. 3, reference numeral 320 stands for a detachable cartridge type liquid jet recording head to which a liquid reservoir is integrated and which is provided with a plurality of ink discharging outlets opposite the recording face of a recording sheet (not shown in the figure) transported on a platen 324. Reference numeral 316 stands for a carriage for holding the liquid jet recording head 320 thereon. The carriage is connected to part of a driving belt 318 which serves to transmit a driving force from a driving motor 317, and it is designed such that it can be moved while sliding on a pair of guide shafts 329A and 329B being arranged in parallel with each other. By this, the liquid jet recording head 320 is made capable of moving back and forth along the entire width of the recording sheet.

Reference numeral 326 stands for a recovery device which serves to recover a defect in liquid discharging from the liquid jet recording head 320 or to prevent occurrence of such defect, and it is disposed at a predetermined position within the range in which the liquid jet recording head 320 is moved, specifically, for example, at a position opposite the home position. The recovery device 326 performs capping to the discharging outlets of the liquid jet recording head 320 by a driving force through a driving mechanism 323 from a motor 322. In connection with the capping performance to the discharging outlets of the liquid jet recording head 320 by means of a cap 326A of the recovery device 326, there is performed suction of liquid from the discharging outlets by means of an appropriate aspirator (not shown in the figure) mounted to the recovery device 326 or force feed of liquid by means of an appropriate pressure means (not shown in the figure) mounted to the liquid supply path of the liquid jet recording head. By this, liquid is forced to discharge through the discharging outlets to thereby conduct recovery treatment including removal of foreign materials such as viscid ink material present in the inside of each of the discharging outlets.

Reference numeral 330 stands for a blade made of silicone rubber capable of serving as a wiping member which is disposed at a side face of the recovery device 326. The blade 330 is held at a blade holding member 330A in the form of a cantilever boom, and it is operated, as well as in the case of the recovery device 326, by means of the motor 322 and the driving mechanism 323 so as to encounter the outlet face of each of the discharging outlets of the liquid jet discharging recording head 320. By this, the blade 330 is projected in the range in which the liquid jet recording head 320 is moved on appropriate timing during recording operation by the liquid jet recording head 320 or after recovery treatment by using the recovery device 326, whereby dew drops, moisture, dusts or the like adhered on the outlet face of each of the discharging outlets of the liquid jet recording head 320 can be swabbed.

In this liquid jet recording apparatus, drive of each of the recording sheet transportation means, the carriage and the recovery device, and drive of the recording head, and the like are controlled based on a demand or signal outputted from a control means containing a CPU disposed on the apparatus body side.

Figure 4:
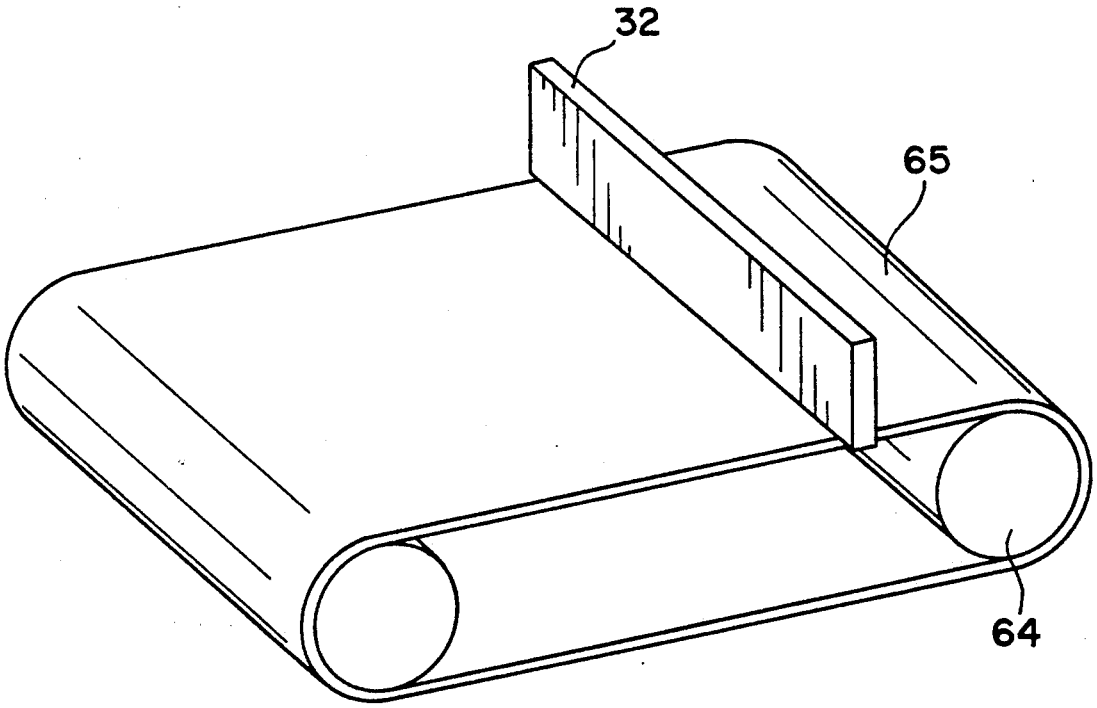
FIG. 4 PRIOR ART
FIG. 4 is a schematic slant view illustrating a rough diagram of a liquid jet recording apparatus provided with a fulling type liquid jet recording head.

FIG. 4 is a schematic slant view illustrating a rough diagram of a liquid jet recording apparatus in which a full-line type liquid jet recording head 32 is installed. In this figure, reference numeral 65 stands for a transportation belt which serves to transport a member on which record is to be made, such as paper.

The transportation of a member on which record is to be made (not shown in the figure) by the transportation belt 65 is performed upon revolution of a transportation roller 64. The lower face of the liquid jet recording head 32 is so designed as to form a discharging outlet face 31 at which a plurality of discharging outlets being arranged so as to correspond to the entire width of the recording area of the member on which record is to be made.

EXAMPLE 1

As shown in FIG. 1(*a*) and FIG. 1(*b*), on a support member 105 comprising a Si single crystal wafer was formed a $SiO_2$ lower layer 106 (layer thickness:5 um) by a thermal oxidation process. On the lower layer 106 was formed a $HfB_2$ layer (layer thickness:1300 Å ) to be the heat generating resistor layer 107 by sputtering $HfB_2$ (of more than 99.9% in purity) as the target in a vacuum chamber. The sputtering conditions in this case were made as follows.

Sputtering conditions the area of the target:8 inch in diameter
high frequency power:1 kW
set temperature of the support member:100° C.
film formation period of time:10 minutes
base pressure:not more than $1\times10^{-4}$ Pa
sputtering gas:argon gas
sputtering gas pressure:0.5 Pa Then, on the $HfB_2$ layer was formed a Ti layer (layer thickness:50 Å) to be the contact layer (not shown in the figure) by an electron beam evaporation process. The conditions in this electron beam evaporation were made as follows.

Electron beam evaporation conditions setting temperature of the support member:150° C.
base pressure:not more than $1\times10^{-4}$ Pa
(controlled by a quartz crystal film thickness monitor so as to provide the foregoing layer thickness.)

Successively, on the Ti layer was formed an Al layer (layer thickness:5000 Å) to be the electrodes 103 and 104 by an electron beam evaporation process. The conditions in this electron beam evaporation were made as follows.

Electron beam evaporation conditions setting temperature of the support member 150° C.
base pressure not than $1\times10^{-4}$ Pa
(controlled by a quartz film thickness measuring device so as to provide the foregoing layer thickness.)

Successively, as for the $HfB_2$ layer, the Ti layer and the Al layer, patterning by photolithography was performed in the following manner. Firstly, photoresist (trademark name:OFPR 800, produced by Tokyo Ohka Company) was applied onto the Al layer to form a layer (layer thickness:1.3 um), which was followed by subjecting to conventional exposure, development and baking. The resultant was subjected to etching with the use of an etching solution comprising a mixed solution comprising acetic acid, phosphoric acid and nitric acid (9% by weight of acetic acid, 73% by weight of phosphoric acid, 2% by weight of nitric acid, and 16% by weight of the residual) to etch the Al layer. Thereafter, the resultant was subjected to reactive etching in a vacuum chamber to etch the $HfB_2$ layer and the Ti layer, and the photoresist was removed. Thus, patterning was completed (pattern width 12 um, the number of patterns:64).

The conditions in the above reactive etching were made as follows.

Reactive etching conditions high frequency power:450 W
etching period of time:5 minutes
base pressure:not more than $1\times10^{-3}$ Pa
etching gas:$BCl_3$
etching gas pressure:3 Pa By patterning each of the $HfB_2$ layer, the Ti layer and the Al layer in the way as above described, there were formed the heat generating layer 107 comprising $HfB_2$, the contact layer (not shown in the figure) comprising Ti, and the electrodes 103 and 104 comprising Al. In this example, the electrode 103 serves as a selective electrode and the electrode 104 serves as a common electrode.

On the thin films-stacked structure thus formed was formed a $SiO_2$ layer (layer thickness:1.0 um) to be the first upper protective later 108 by sputtering $SiO_2$ (of more than 99.9% in purity) in a vacuum chamber.

Successively, there was formed a Ta layer (layer thickness:0.3 um) to be the second upper protective layer 109 by sputtering Ta (of more than 99.9% in purity) as the target in a vacuum chamber. The Ta layer thus formed was then followed by subjecting to reactive etching in a vacuum chamber to thereby form the second upper protective layer 109 having such pattern that covers the surface portion of the heat generating portion 111 as shown in FIG. 1(*a*) and FIG. 1(*b*). The conditions in this reactive etching were made as follows.

Reactive etching conditions high frequency power:500 W
etching period of time:10 minutes
base pressure:not more than $1\times10^{-3}$ Pa
etching gas:$CF_4$ and $O_2$
etching gas pressure:10 Pa On the thin films-stacked structure thus formed was applied a coating material obtained by mixing 3 percent by weight of inorganic ion exchanger (trademark name-:IXE, product by Toagosei Chemical Industry Co., Ltd.) with photosensitive polyimide (trademark name : PHOTONEECE, product by Toray Industries, Inc.) to form a layer, which was followed by subjecting to conventional exposure, development and baking. The conditions in the exposure, development and baking were made as follows.

Exposure, development and baking conditions prebaking:at 90° C. for 30 minutes
exposure Ultraviolet ray, 200 mJ/cm$^2$
development:at 25° C. for one minute using an exclusive developing solution
post baking:at 140° C. for 30 minutes, then at 300° C. for 60 minutes Thus, there was formed the third upper protective layer 110 having such pattern that covers the surface portion of each of the electrodes 103 and 104 as shown in FIG. 1(*a*) and FIG. 1(*b*). By this, the preparation of the substrate 101 for liquid jet recording head in this example was completed.

On the substrate 101 for liquid jet recording head thus obtained was disposed a wall member 200 to form side walls between the liquid pathways 201 in communication with the discharging outlets 202 and the common liquid chamber 204 through lithography of a photosensitive, resin layer (layer thickness:50 um), and there was disposed atop wall member 200 plate 205 made of glass thereon and adhered by an epoxy resin adhesive (not shown in the figure), whereby a liquid jet recording head of the configuration schematically shown in FIG. 2 was obtained. This liquid jet recording head had 64 discharging outlets corresponding to the foregoing heat generating portions, in which reference numeral 206 stands for a liquid throughhole.

In this example, there were prepared 100 liquid jet recording heads of the above constitution in total.

EXAMPLE 2

The procedures of Example 1 were repeated, except that the inorganic layer to be the first upper protective layer 108 containing $SiO_2$ as the main constituent and the ion exchanger was formed by applying a coating material obtained by adding 3 percent by weight of an inorganic ion exchanger (trademark name:IXE, product by Toagosei Chemical Industry Co., Ltd.) to OCD (trademark name, product by Tokyoohka Kabushiki Kaisha) in an amount to provide a thickness of 1 um, followed by baking at 450° C. for 30 minutes; and photosensitive polyimide (trademark name:-PHOTONEECE, product by Toray Industries Inc.) not containing any inorganic ion exchanger was used as the material for the formation of the third upper protective layer 110, to thereby obtain a substrate for liquid jet recording head and a liquid jet recording head provided with said substrate.

There were prepared 100 liquid jet recording heads in total also in this example.

Comparative Example

The procedures of Example 1 were repeated, except that photosensitive polyimide (trademark name:-PHOTONEECE, product by Toray Industries Inc.) not containing any inorganic ion exchanger was used as the material for the formation of the third upper protective layer 110, to thereby obtain a substrate for liquid jet recording head and a liquid jet recording head provided with said substrate.

There were prepared 100 liquid jet recording heads in total also in this comparative example.

Comparative Experiments

As for the 100 substrates for liquid jet recording head obtained in each of Examples 1 to 2 and Comparative Example, observation was made about the situation of occurrence of corrosion at the electrodes. As a result, it was found that the incidence of said corrosion in both Examples 1 and 2 is markedly reduced on average in comparison with that in Comparative Example.

Further, as for the 100 liquid jet recording heads obtained in each of Examples 1 and 2 and the Comparative Example, each of them was set to the liquid jet recording apparatus body shown in FIG. 3 to discharge recording liquid of the following composition, whereby recording was performed.

The composition of the recording liquid used

C.I. Food Black:3.0 wt. %
(The C.I. Food Black contains 10 wt. % of sodium ion therein. In other words, 0.3 wt. % of sodium ion is contained in the recording liquid.)
triethylene glycol:10 wt. %
diethylene glycol:20 wt. %
demineralized water:67 wt. %

As a result, it was found that the quality of the record obtained by using any of the liquid jet recording heads obtained in Examples 1 and 2 markedly surpassed that obtained by using any of the liquid jet recording heads obtained in the Comparative Example. It is considered that this result was brought about mainly because of an improved reliability of each of the liquid jet recording heads obtained in Examples 1 and 2 which is markedly small in the incidence of corrosion at the electrothermal converting body including the electrodes as above described.

The present invention provides marked effects in a recording head and a recording apparatus of the system in which ink is discharged utilizing thermal energy.

As for the representative constitution and the principle, it is desired to adopt such fundamental principles as disclosed, for example, in U.S. Pat. No. 4,723,129 or U.S. Pat. No. 4,740,796. While this system is capable of applying to either the so-called on-demand type or the continuous type, it is particularly effective in the case of the on-demand type because, by applying at least one driving signal for providing a rapid temperature rise exceeding nucleate boiling in response to recording information to an electrothermal converting body disposed for a sheet on which liquid (ink) is to be held or for a liquid pathway, the electrothermal converting body generates thermal energy to cause film boiling in the ink at a heat acting face of the recording head and as a result, a gas bubble can be formed in the liquid (ink) in a one-by-one corresponding relationship to such driving signal. By way of growth and contraction of this gas bubble, the liquid (ink) is discharged through a discharging outlet to form at least one droplet. It is more desirable to make the driving signal to be of a pulse shape, since in this case, growth and contraction of a gas bubble take place instantly and because of this, there can be attained discharging of the liquid (ink) excelling particularly in responsiveness. As the driving signal of pulse shape, such driving signal as disclosed in U.S. Pat. No. 4,463,359 or U.S. Pat. No. 4,345,262 is suitable. Additionally, in the case where those conditions disclosed in U.S. Pat. No. 4,313,124, which relates to the invention concerning the rate of temperature rise at the heat acting face, are adopted, further improved recording can be performed.

As for the constitution of the recording head, the present invention includes, other than those constitutions of the discharging outlets, liquid pathways and electrothermal converting bodies in combination (linear liquid flow pathway or perpendicular liquid flow pathway) which are disclosed in each of the above patent specifications, the constitutions using such constitution in which a heat acting portion is disposed in a curved region which is disclosed in U.S. Pat. No. 4,558,333 or U.S. Pat. No. 4,459,600. In addition, the present invention may effectively take a constitution based on the constitution in which a slit common to a plurality of electrothermal converting bodies is used as a discharging portion of the electrothermal converting bodies which is disclosed in Japanese Laid-Open Patent Application No. 123670/1984 or other constitution based on the constitution in which an opening for absorbing a pressure wave of thermal energy is made to be corresponding to a discharging portion which is disclosed in Japanese Laid-Open Patent Application No. 138461/1984.

Further, as the full-line type recording head having a length corresponding to the width of a maximum record medium which can be recorded by a recording apparatus, there can be employed either such constitution that the length is completed by such a combination of a plurality of recording heads as disclosed in the foregoing specifications or other constitution comprising a single recording head formed as an integrated structure, and in either case, the present invention provides the foregoing effects further effectively.

The present invention is effective also in the case where a recording head of the exchangeable chip type wherein electric connection to an apparatus body or supply of ink from the apparatus body is enabled when it is mounted on the apparatus body or other recording head of the cartridge type wherein an ink tank is integrally provided on the recording head itself is employed.

Further, it is desirable to add restoring means to a recording head or preparatory auxiliary means or the like as a constituent of the constitution of the recording apparatus according to the present invention in view of stabilizing the effects of the present invention. Specifically in this respect, capping means, cleaning means, pressurizing or attracting means, preliminary heating means including an electrothermal converting body or a separate heating element or a combination of these for the recording head, and to employ a preparatory discharging mode in which discharging is performed separately from recording, are also effective in order to achieve stable recording.

Furthermore, the present invention is extremely effective not only in a recording apparatus which has, as the recording mode, a recording mode of a main color such as black but also in an apparatus which includes a plurality of different colors or at least one of full-colors by color mixture, in which a recording head is integrally constituted or a plurality of recording heads are combined.

In the above-mentioned examples of the present invention, explanation was made with the use of liquid ink, but it is possible to use such ink that is in a solid state at room temperature or other ink that becomes to be in a softened state at room temperature in the present invention. In the foregoing ink jet apparatus, it is usual to adjust the temperature of ink itself in the range of 30° C. to 70° C. such that the viscosity of ink lies in the range capable of being stably discharged. In view of this, any ink can be used as long as it is in a liquid state upon the application of a record signal. In addition, in the present invention, it is also possible to use those inks having a property of being liquefied, for the first time, with thermal energy, such as ink that can be liquefied and discharged in liquid state upon application of thermal energy depending upon a record signal or other ink that can start its solidification beforehand at the time of its arrival at a recording medium in order to prevent the temperature of the head from raising due to thermal energy by purposely using thermal energy as the energy for a state change of ink from solid state to liquid state or in order to prevent ink from being vaporized by solidifying the ink when allowed to stand. In the case of using these inks, it can be used in such manner as disclosed in Japanese Laid-Open Patent Application No. 56847/1979 or Japanese Laid-Open Patent Application No. 71260/1985 that such ink is maintained in concaved portions or penetrations of a porous sheet in a liquid state or in a solid state and the porous sheet is arranged to be such a configuration opposite to the electrothermal converting body. In the present invention, the most effective discharging system for each of the above-mentioned inks is the foregoing film-boiling system.

I claim:

1. A liquid jet recording head comprising:

a substrate comprising a support member, an electrothermal converting body being disposed above said support member, said electrothermal converting body including a heat generating resistor layer and electrodes being electrically connected to said heat generating resistor layer, and an upper protective layer containing an ion exchanger being disposed to cover said electrothermal converting body; and a liquid pathway being disposed on said substrate, wherein said liquid pathway is in communication with a discharging outlet capable of discharging liquid, and said liquid pathway is disposed to correspond to a heat generating portion of said electrothermal converting body.

2. A liquid jet recording head according to claim 1, wherein the ion exchanger is an inorganic ion exchanger.

3. A liquid jet recording head according to claim 1, wherein the upper protective layer contains the ion exchanger in an amount of 1 to 5 wt. %.

4. A liquid jet recording head according to claim 1, wherein the ion exchanger is dispersed within the upper protective layer.

5. A liquid jet recording head according to claim 1, wherein the material of the upper protective layer containing the ion exchanger is an organic material.

6. A liquid jet recording head according to claim 1, wherein the material of the upper protective layer containing the ion exchanger is an inorganic material.

7. A liquid jet recording head according to claim 1, wherein a lower layer is disposed between the support member and the electrothermal converting body.

8. A liquid jet recording head according to claim 1, wherein the liquid contains mobile ions.

9. A liquid jet recording head according to claim 8, wherein the mobile ions are sodium ions.

10. A liquid jet recording head according to claim 8, wherein the mobile ions are chlorine ions.

11. A liquid jet recording head according to claim 1 which is of a full-line type in which the discharging outlet comprises a plurality of discharging outlets being arranged along the entire width of a recording area of a member on which a record is to be made with the liquid jetted out from said discharging outlets.

12. A substrate for liquid jet recording head, said substrate comprising:

a support member;

an electrothermal converting body being disposed above said support member, said electrothermal converting body including a heat generating resistor layer and electrodes being electrically connected to said heat generating resistor layer; and an upper protective layer containing an ion exchanger disposed to cover said electrothermal converting body.

13. A substrate for liquid jet recording head according to claim 12, wherein the ion exchanger is an inorganic ion exchanger.

14. A substrate for liquid jet recording head according to claim 12, wherein the upper protective layer contains the ion exchanger in an amount of 1 to 5 wt. %.

15. A substrate for liquid jet recording head according to claim 12, wherein the ion exchanger is dispersed within the upper protective layer.

16. A substrate for liquid jet recording head according to claim 12, wherein the material of the upper protective layer containing the ion exchanger is an organic material.

17. A substrate for liquid jet recording head according to claim 12, wherein the material of the upper protective layer containing the ion exchanger is an inorganic material.

18. A substrate for liquid jet recording head according to claim 12, wherein a lower layer is disposed between the support member and the electrothermal converting body.

19. A liquid jet recording apparatus comprising:

a liquid jet recording head which comprises a substrate that includes a support member, an electrothermal converting body being disposed above said support member, said electrothermal converting body including a heat generating resistor layer and electrodes being electrically connected to said heat generating resistor layer, and an upper protective layer containing an ion exchanger being disposed to cover said electrothermal converting body, and a liquid pathway being disposed on said substrate, wherein said liquid pathway is in communication with a discharging outlet capable of discharging liquid, and said liquid pathway is disposed to correspond to a heat generating portion of said electrothermal converting body; and transportation means for transporting a member on which a record is to be made with said liquid jetted out from said discharging outlet.

20. A liquid jet recording apparatus according to claim 19, wherein the liquid jet recording head is of a full-line type in which the discharging outlet comprises a plurality of discharging outlets being arranged along with the entire width of a recording area of a member on which the record is to be made with the liquid jetted out from said discharging outlets.

* * * * *

UNITED STATES PATENT AND TRADEMARK OFFICE

CERTIFICATE OF CORRECTION

PATENT NO. : 5,187,499 Page 1 of 2

DATED : February 16, 1993

INVENTOR(S) : Keiichi MURAKAMI

It is certified that error appears in the above-indentified patent and that said Letters Patent is hereby corrected as shown below:

AT [57] - ABSTRACT:

Line 6, "a" should read --an--.

COLUMN 3:

Line 25, "record" should read --a record--;

Line 34, "and studies" should be deleted;

Line 35, "subject" should read --problem--.

COLUMN 4:

Line 39, "fulling" should read --full-line--.

COLUMN 5:

Line 6, "forms to be" should read --forms--.

COLUMN 6:

Line 41, "being suffered" should read --suffering--;

Line 61, "the" (second occurrence) should be deleted;

Line 62, "take" should read --provide--.

UNITED STATES PATENT AND TRADEMARK OFFICE

CERTIFICATE OF CORRECTION

PATENT NO. : 5,187,499 Page 2 of 2

DATED : February 16, 1993

INVENTOR(S) : Keiichi MURAKAMI

It is certified that error appears in the above-indentified patent and that said Letters Patent is hereby corrected as shown below:

COLUMN 10:

Line 14, "member 150°" should read --member : 150°--;

Line 15, "pressure not" should read --pressure : not more--.

COLUMN 16:

Line 36, "with" should be deleted.

Signed and Sealed this

Twelfth Day of April, 1994

Bruce Lehman

*Attest:*

BRUCE LEHMAN

*Commissioner of Patents and Trademarks*

*Attesting Officer*